US007077046B2

(12) United States Patent
Nelyubin

(10) Patent No.: US 7,077,046 B2
(45) Date of Patent: Jul. 18, 2006

(54) RESONANCE IN ELECTROMAGNETIC LAUNCHERS

(76) Inventor: Alexandr Nelyubin, 52-56 Soviet Army st., Novokuznetsk 654040 (RU)

( * ) Notice: Subject to any disclaimer, the term of this patent is extended or adjusted under 35 U.S.C. 154(b) by 0 days.

(21) Appl. No.: 10/209,678

(22) Filed: Aug. 1, 2002

(65) Prior Publication Data

US 2004/0020351 A1 Feb. 5, 2004

(51) Int. Cl.
*F41F 1/00* (2006.01)

(52) U.S. Cl. ..... 89/8; 124/3; 310/12
(58) Field of Classification Search ..... 89/8; 124/3; 310/12
See application file for complete search history.

(56) References Cited

U.S. PATENT DOCUMENTS 1,985,254 A * 12/1934 Huse ..... 310/13
4,432,333 A * 2/1984 Kurherr ..... 124/3
4,997,047 A * 3/1991 Schroeder ..... 175/4.5
5,024,137 A * 6/1991 Schroeder ..... 89/8
5,076,136 A * 12/1991 Aivaliotis et al. ..... 89/8
5,217,948 A * 6/1993 Leung et al. ..... 124/3
5,431,083 A * 7/1995 Vassioukevitch ..... 89/8
5,454,289 A * 10/1995 Bacon et al. ..... 89/8
5,458,043 A * 10/1995 Jensen et al. ..... 89/8
5,483,863 A * 1/1996 Dreizin ..... 89/8
5,865,630 A * 2/1999 Nakano ..... 439/48
5,869,911 A * 2/1999 Tanaka ..... 310/12
5,950,608 A * 9/1999 Tidman ..... 124/6

* cited by examiner

*Primary Examiner*—J. Woodrow Eldred

(57) ABSTRACT

The present invention considers the problem of energizing large electric current, electromagnetic driving force and acceleration in coilguns by means of electromagnetic resonant oscillations, both in the armature, that represents the oscillatory contour consisting of the coil and the capacitor and in the stator coils.

4 Claims, 12 Drawing Sheets

$$R_1 i_1 + L_1 \frac{di_1}{dt} + M \frac{di_2}{dt} = U_m \cos(\omega t + \varphi)$$

$$R_2 i_2 + M \frac{di_1}{dt} + L_2 \frac{di_2}{dt} + u_c = 0$$

$$\frac{du_c}{dt} = -\frac{i_2}{c}$$

$$R_1 i_1 + L_1 \frac{di_1}{dt} + M_{12} \frac{di_2}{dt} + M_{13} \frac{di_3}{dt} + \ldots + M_{1n} \frac{di_n}{dt} + M_{1b} \frac{di_b}{dt} + i_b V \frac{dM_{1b}}{dx} = u_m cos(\omega t + \varphi)$$

FIG.9 {Amended}

$$R_2 i_2 + M_{21} \frac{di_1}{dt} + L_2 \frac{di_2}{dt} + M_{23} \frac{di_3}{dt} + \ldots + M_{2n} \frac{di_n}{dt} + M_{2b} \frac{di_b}{dt} + i_b V \frac{dM_{2b}}{dx} = u_m cos(\omega t + \varphi)$$

FIG.10 {Amended}

$$R_n i_n + M_{n1} \frac{di_1}{dt} + M_{n2} \frac{di_2}{dt} + M_{n3} \frac{di_3}{dt} + \ldots + L_n \frac{di_n}{dt} + M_{nb} \frac{di_b}{dt} + i_b V \frac{dM_{nb}}{dx} = u_m cos(\omega t + \varphi)$$

FIG.11 {Amended}

$$R_b i_b + L_b \frac{di_b}{dt} + M_{b1} \frac{di_1}{dt} + M_{b2} \frac{di_2}{dt} + \ldots + M_{bn} \frac{di_n}{dt} + V \sum_{k=1}^{n} i_k \frac{dM_{kb}}{dx} + u_c = 0$$

FIG.12 {Amended}

$$\frac{du_c}{dt} = -\frac{i_b}{c}$$

FIG.13

$$\frac{dV}{dt} = \sum_{k=1}^{n} \frac{i_k i_b}{m} \frac{dM_{kb}}{dx} - g$$

FIG.14

$$\frac{dx}{dt} = V$$

FIG.15

RESONANCE IN ELECTROMAGNETIC LAUNCHERS

BACKGROUND OF THE INVENTION

Now electromagnetic launchers are developed widely and intensively because potentially achievable velocities of bodies in them are rather higher, than it can be received practically in typical thermodynamic guns.

The achievement of very high velocity on electromagnetic launchers will help to solve many military, technical, commercial and scientific problems, such as earth-to-orbit launching of various designs and materials, removal of nuclear waste products, development of new materials and others.

One of the kinds of electromagnetic launchers are coilguns. The coilguns consist of one cylindrical coil or the array of coaxial cylindrical coils located sequentially one after another. The internal diameter of these coils forms the barrel of a launcher. Each coil is connected to the store of high-power energy, such as—inductive store, capacitor store, shock homopolar generator and others. As a rule, the metal cylinder is applied as an armature, which is considered as a short-circuited coil.

The force of interaction between the armature and the coils of the launcher is increasing, if the current flowing in the coils of the launcher and in the armature is increasing. Large values of current and magnetic field in the coil result in many problems. The powerful magnetic field causes the large radial and axial forces that tend to compress the coil in axial direction and to increase the diameter in radial one.

The current flowing in the armature is the current of short circuit and it is used mostly for heating of the armature. It reduces considerably the efficiency of the transformation's electric energy impulse in the kinetic energy of the armature movement.

The impulse of current from the store energy is a high-power impulse and it has small duration. In this connection, there is a problem of creation both high-power and high-speed breakers. In case of sequential switching of the launcher coils it is necessary to solve a problem of synchronous. At each next step of acceleration it is necessary to bring greater impulse of energy to the launcher coil than on one.

SUMMARY OF THE INVENTION

The first embodiment of the invention concerns the armature design, or further the rotor. The rotor represents the electromagnetic oscillatory contour consisting of a coil and a capacitor. A coil and a capacitor are placed in the uniform cylindrical case at some distance from each other and connected with each other. The coil is made of a superconductive material or a metal with low specific resistance. The wire of the coil can withstand electric current of big amplitude. The capacitor represents the high-voltage capacitor with high specific power consumption both of volume and of weight.

The second embodiment of the invention concerns electromagnetic accelerating installation, or further the stator. The stator represents a longitudinal array of coils, with the internal diameter of which more than is the external diameter of a rotor on a small air gap. The length of the stator coils is less than the length of the rotor coil. The stator coils have the same direction of winding and these coils are connected to an alternator with the frequency equal to the frequency of own resonant electromagnetic oscillation of the rotor circuit.

The current in the stator coils energizes current in the rotor coil with the help of mutual inductance and causes alternative electromagnetic oscillations in the rotor's electric circuit. In the process of rotor's movement, the stator coil which remain behind of midplane the rotor coil, is disconnected from the alternator by a high-speed breaker. Electromagnetic forces accelerate the rotor from breech to muzzle of the launcher.

In the third embodiment of the invention the methods of charging the rotor to initial nonzero values of electromagnetic energy in breech of the launcher are considered.

In the first variant, the rotor capacitor is charged from a source of direct current.

In the second variant, the rotor capacitor and the rotor coil are connected in series to the alternator with the frequency equal to the frequency of own resonant electromagnetic oscillation in the rotor's electric circuit.

In the third variant, the rotor capacitor and the rotor coil are connected in parallel to the alternator and the electric circuit of the rotor remains closed. The frequency of the alternator is equal to the frequency of resonant electromagnetic oscillations in the rotor's electric circuit.

In the fourth variant, an additional coil is placed in the breech of the stator. It is a coaxial coil with the rotor coil in such a way, that the centers of both coils coincide and the internal diameter is more than the external diameter of a rotor on a small air gap. Before acceleration of the rotor, this additional coil is connected to the alternator with the frequency equal to the frequency of resonant electromagnetic oscillations in the rotor's electric circuit. The additional coil energizes resonant electromagnetic oscillations in the rotor's electric circuit with the help of mutual inductance.

In the fourth embodiment of the invention the problem of connection the stator coils to low-voltage and low-current sources of alternating current is considered. For this purpose, capacitors are connected in the stator coils circuit. The electric capacity of the capacitors is selected so that they create resonant oscillatory contours together with the stator coils, with the frequency of resonant oscillations equal to the frequency of own resonant oscillations of the rotor's electric circuit.

In the first variant, the capacitors are connected in series with the stator coils. In the second variant, the capacitors are connected in parallel with the stator coils.

BRIEF DESCRIPTION OF THE DRAWINGS

FIG. 9 shows the voltage equation in the differential form for the electric circuit of the first stator's coil.

FIG. 10 shows the voltage equation in the differential form for the electric circuit of the second stator's coil.

FIG. 11 shows the voltage equation in the differential form for the electric circuit of the stator coil with number "n".

FIG. 12 shows the voltage equation in the differential form for the electric circuit of the rotor.

FIG. 13 shows the differential equation for voltage in the rotor capacitor.

FIG. 14 shows the differential equation for rotor's velocity.

FIG. 15 shows the differential equation for rotor's movement.

DETAILED DESCRIPTION OF THE INVENTION

The idea of the present invention is the creation of the large electric current, electromagnetic driving force and acceleration in coilguns by means of electromagnetic resonant oscillations in the rotor, that consist of the coil and the capacitor.

In general, the resonance of circuit is understood as such state of a circuit when the current and voltage coincide with phase, therefore, the equivalent circuit, represents as active resistance.

Such a state of a circuit takes place at the certain ratio of its parameters-resistance, inductance, electric capacity and when resonant frequency of a circuit is equal to voltage's frequency of the power supply.

The resonance in an electric circuit is accompanied by periodic transition of the energy of electric field of a capacitor in the energy of magnetic field of a coil and vice versa.

At the resonance in an electric circuit, the small voltage of the power supply can cause significant current and voltage on separate elements of the circuit. The resonance can be received either by choice of the circuit parameters at the present frequency of the power supply, or by choice of the frequency's power supply at the present parameters of the circuit.

For the better understanding of the present invention, we shall consider the analogue of the air transformer. The primary and secondary windings of the air transformer represent coaxial solenoids, in that the internal diameter of the solenoid's primary winding is more than the external diameter of the solenoid's secondary winding on minimal air gap.

Figure 1:
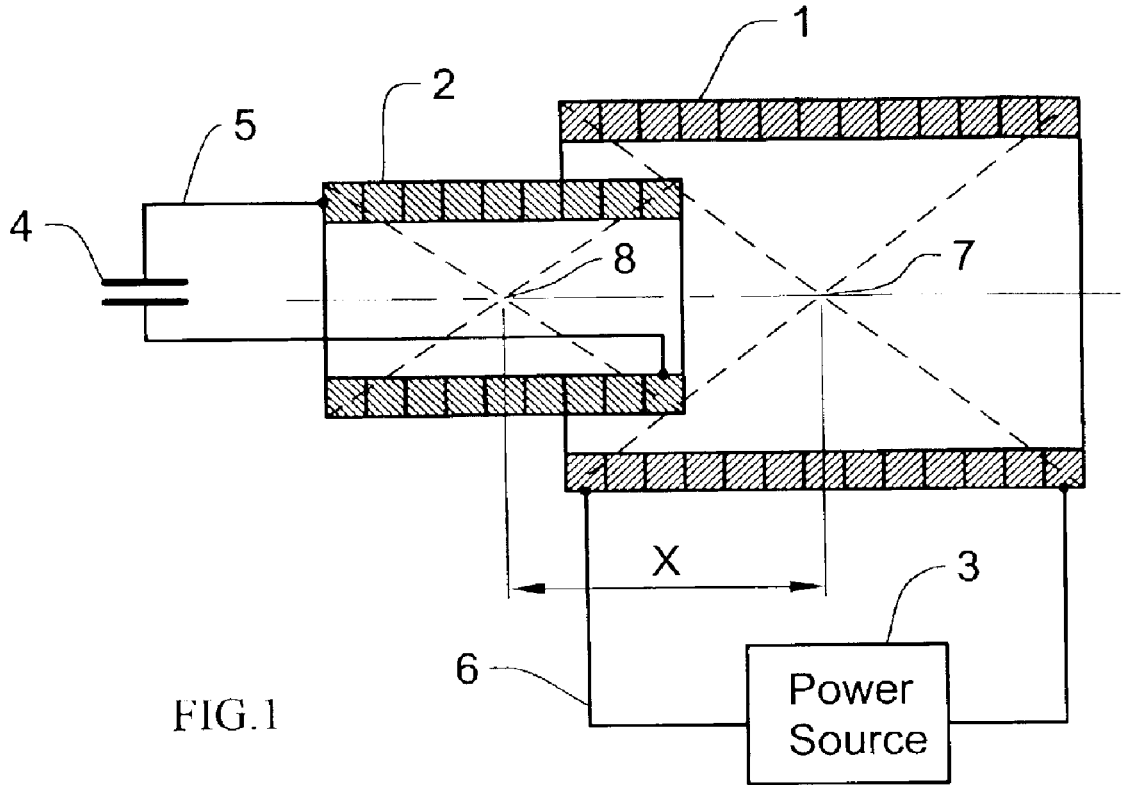
FIG. 1 shows the air transformer schematically.

This air transformer is shown on FIG. 1 schematically.

Figure 2:
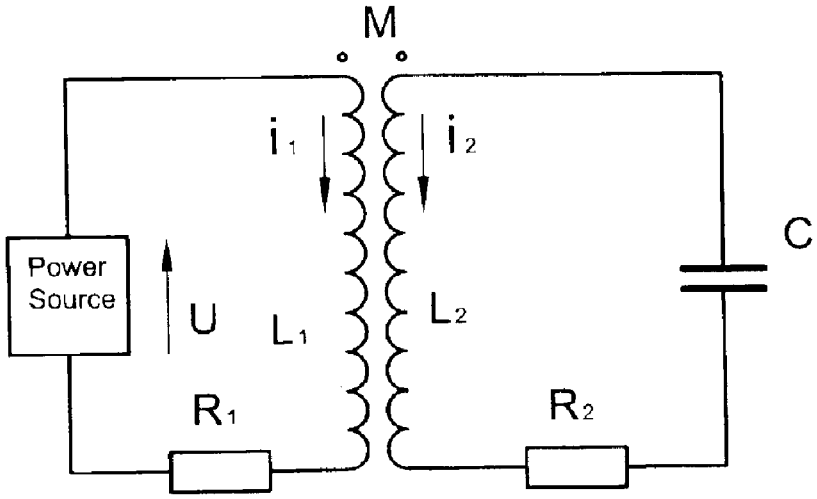
FIG. 2 shows electric equivalent circuit of the air transformer.

The primary winding 1 of the transformer is connected by means of the connecting wires 6 to the alternator 3. The secondary winding 2 of the transformer is connected by means of connecting wires 5 to the capacitor 4. The primary winding center 7 is placed in some distance "X" from the secondary winding center 8. The equivalent circuit of the air transformer is shown in FIG. 2.

Let's assume, that the geometrical sizes of coils do not change, thus inductance remains constant.

Figures 3, 4, 5, 6:
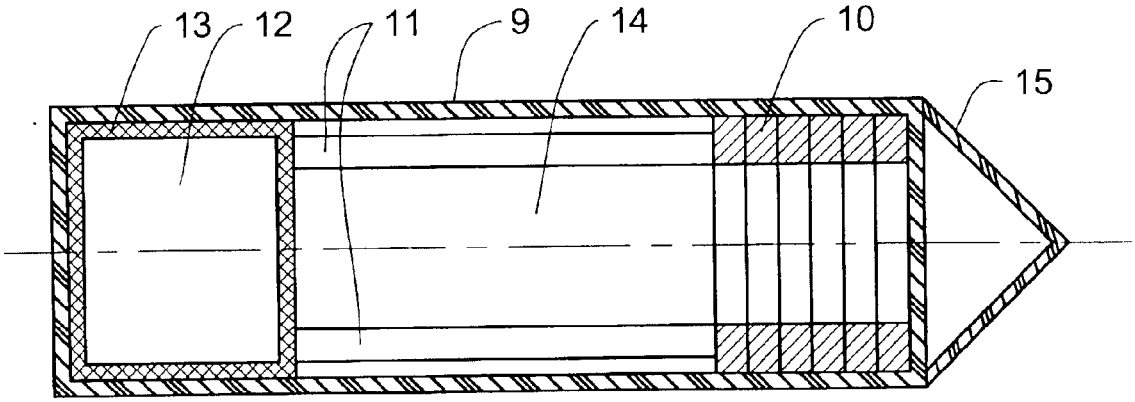
FIG. 3 shows the voltage equation in the differential form for electric circuit of the primary winding of the air transformer.
FIG. 4 shows the voltage equation in the differential form for electric circuit of the secondary winding of the air transformer.
FIG. 5 shows the differential equation for voltage in the capacitor.
FIG. 6 shows the rotor's design schematically.

The voltage equation by the rule of Kirchhoff in the differential form for the circuit's primary winding is shown on FIG. 3.

The voltage equation by the rule of Kirchhoff in the differential form for the circuit's secondary winding is shown in FIG. 4.

The voltage equation of the capacitor in the differential form is shown in FIG. 5.

Where $R_1$=total resistance of the primary winding and in the circuit;

$R_2$=total resistance of the secondary winding and in the circuit;

C=electric capacity of the capacitor;

$L_1$, $L_2$=total inductance of the primary and secondary windings and in the circuit;

$i_1$, $i_2$=instant values of current in the primary and secondary windings;

$u_c$=instant value of the capacitor voltage;

$U_m$=voltage's amplitude;

ω=voltage's circular frequency;

ϕ=voltage's initial phase;

M=mutual inductance between of the primary and secondary windings.

If the frequency of the alternator is equal to own oscillation frequency of the electric circuit $L_2CR_2$, in the circuit's secondary winding there will be resonant electromagnetic oscillations. The amplitude of voltage in the capacitor C and the amplitude of current in the coil $L_2$ will increase.

As the secondary winding is generating for circuit $L_2CR_2$ so the current $i_2$ will coincide with the current $i_1$ in the direction. Currents of the primary and secondary windings will be variable both by amplitude and sign, but the polarity of these currents in each half-cycle of oscillations will coincide, so that the multiplication $i_1$ and $i_2$ will be positive.

Resulted axial force of interaction between coils can be calculated from energy reasons. The change of electromagnetic energy at possible movement coils is equal to multiplication of the force of interaction between the coils on virtual movement.

$$F=dW/dx=i_1i_2dM/dx.$$

Where W=magnetic energy;

F=force of interaction;

$i_1$, $i_2$=instant values of current in the primary and secondary windings;

dM/dx=differential of mutual inductance between coils of the transformer at movement coils on "dx".

Thus, in the case of concurrence of the current phases in the primary and secondary windings, electromagnetic force F will be directed for the increase in mutual inductance M. It will tend to pull the centers of solenoids to each other and will have variable value by amplitude in spite of movement.

Such a system will tend to the greater accumulation of energy in oscillatory contour $L_2CR_2$ up to the extreme peak values of voltage in the capacitor C and current $i_2$ in the coil $L_2$.

In the given invention, the rotor of the electromagnetic launcher is made as the device represented in FIG. 6 schematically.

The cylindrical case 9 of the rotor is made of a nonmetal material. The coil 10 is placed in the head part of the rotor. The coil is made of a superconducting material or a metal with low specific resistance. The wire of the coil is designed for withstanding the electric current of big amplitude. The capacitor 12 is located in the bottom of the rotor and connected to the coil 10 by means wires 11. The capacitor 12, represents the high-voltage capacitor with high specific power consumption both of volume and of weight. The capacitor 12 is protected from the influence of magnetic field by the protective case 13. There is the hollow part 14 between the coil 10 and the capacitor 12. The rotor is supplied with the fairing 15. Thus, the rotor is divided in three parts—inductive, hollow and capacitor.

The hollow part of the rotor is intended for the reduction of influence of electromagnetic field on the rotor capacitor.

Figure 7:
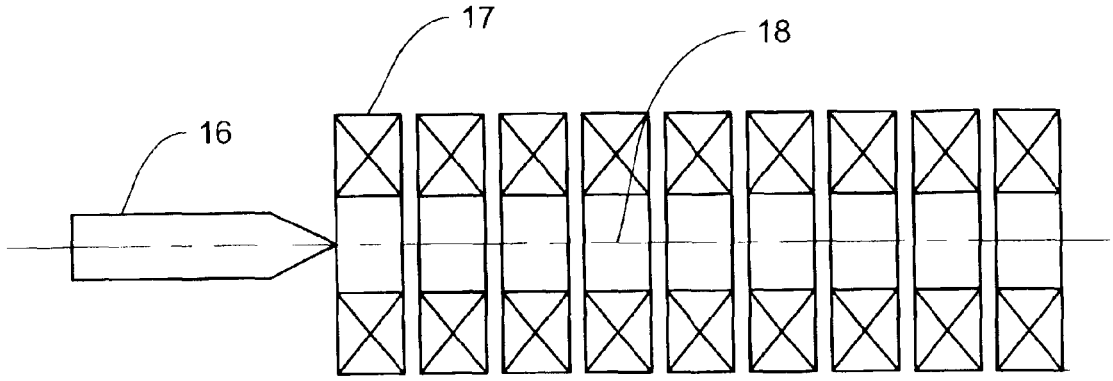
FIG. 7 represents the electromagnetic launcher with the rotor schematically.

The electromagnetic launcher is represented in FIG. 7 schematically. It consists of the array of coaxial coils 17, of the same internal diameter, put one by one. The length of these coils is less than the length of the rotor coil. The coils have same direction of winding and they are connected to the alternator in one direction. The internal diameter of the coils is more than the external diameter of the rotor in the minimal air gap and the internal diameter of the coils forms the barrel 18 on which the rotor 16 is moving.

Figure 8:
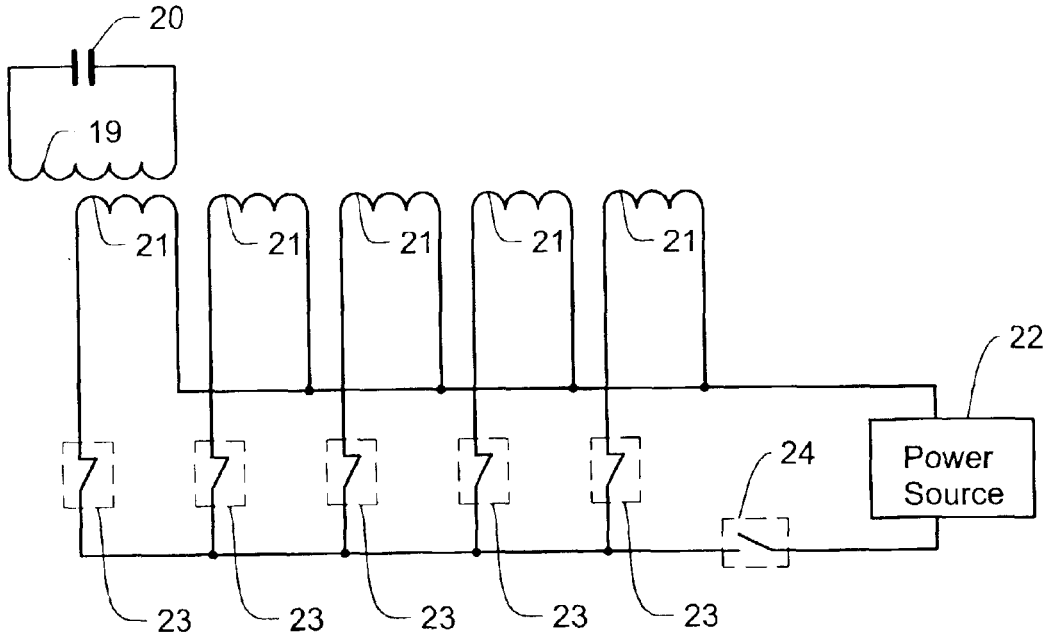
FIG. 8 shows the simplified circuit of the electromagnetic launcher with the rotor.

The simplified electric equivalent circuit of the rotor and the stator is shown in FIG. 8. In this circuit and the next one only five coils of the stator are shown. The total resistance of each coil, connecting wires and circuits, and also the resistance of electric circuit of the rotor are not shown.

The alternative sine wave current is flowing in the stator coils 21 after switching-on the breaker 24. Magnetic field of coils will induce current in the rotor coil 19. As the frequency of the current in the stator coils is equal to the own oscillation frequency of the rotor's electric circuit, there will be resonant electromagnetic oscillations in electric circuit of the rotor. The amplitude of current in the rotor coil 19 and the amplitude of voltage in the rotor capacitor 20 will increase quickly.

Let's assume, that the number of the stator coils is equal "n". And all of them are numbered, in the direction from breech to muzzle of the launcher, numbers 1, 2, 3, . . . and so on up to the number "n".

We admit that the inductance of the stator coils and the rotor coil remain constant during of rotor's acceleration.

Thus, the voltage equation by the rule of Kirchhoff in the differential form for the first stator coil will be written as shown in FIG. 9.

The voltage equation by the rule of Kirchhoff in the differential form for the second stator coil will be written as shown in FIG. 10.

Thus, it is possible to write the voltage equation in the differential form for each the stator coil. The equations for all the coils will make up a system of the differential equations with the number of "n".

The voltage equation by the rule of Kirchhoff in the differential form for the stator coil at the number "n" will be written as shown in FIG. 11.

The voltage equation by the rule of Kirchhoff in the differential form for electric circuit of the rotor will be written as shown on FIG. 12.

The differential equation for voltage in the rotor capacitor is shown in FIG. 13.

Where $L_b$=inductance of the rotor's electric circuit;

C=electric capacity of the rotor capacitor;

$R_b$=total resistance of the rotor's electric circuit;

$i_b$=instant value of current in the rotor coil;

n=number of the stator coils;

$L_1$, $L_2$, $L_3$ . . . $L_n$=total inductance of the stator coils and in circuits;

$R_1$, $R_2$, $R_3$ . . . $R_n$=total resistance of the stator coils and in circuits;

$i_1$, $i_2$, $i_3$ . . . $i_n$=instant values of current in the stator coils;

$u_c$=instant value of the capacitor voltage;

$u_m$=voltage's amplitude;

ω=voltage's circular frequency;

ϕ=voltage's initial phase;

$M_{kj}$=mutual inductance between the stator coils under numbers "k" and "j" where "k" and "j" change from "1" to "n";

$M_{b1}$, $M_{b2}$ . . . $M_{bn}$=mutual inductance between the stator coil with the number "i" and the rotor coil "b", where "i" changes from "1" to "n";

$dM_{bk}/dx$=differential of mutual inductance between the stator coil with number "k" and the rotor coil "b" at movement of a rotor on "dx"
where "k" changes from "1" to "n";

V=rotor's velocity.

The stator coils will form the solenoid. Electromagnetic force of interaction between current in the rotor coil and in the stator coils will tend to pull in the rotor coil and together with it and the whole rotor with it to the center of the formed solenoid.

In the process of the rotor movement, the stator coil that remains behind the rotor coil, will also pulling in to itself the rotor coil. It will not accelerate, and it will to brake the rotor already. For eliminating this braking it is necessary the stator coils don't participate during acceleration of the rotor to disconnect from the power supply by high-speed breakers 23 in accordance with the movement of the rotor and consecutively in the direction from breech to muzzle of the launcher.

Thus, the head part of the rotor and the rotor coil will be as on an entrance in the solenoid during all the time of acceleration. In the first moment the solenoid is formed from the first coil to the coil number "n". After switching-off the first coil, the solenoid is formed from the second coil to the coil number "n". Then, after switching-off the first coil and the second coil, the solenoid is formed from the third coil to the coil number "n" and so on to the final from the coil number "n−1" to the coil number "n" and only from the coil number "n".

The moments of disconnection of breakers will be coordinated for each launcher separately.

The calculation shows that is possible to achieve maximum of differential mutual inductance "dM" at movement "dx" between the rotor coil and the stator coils if the rotor coil is placed into the solenoid by the size of about ½ length of the rotor coil. Thus, any stator coil placed behind the center of the rotor coil in the movement direction should be switched.

In an ideal case, the stator coils should be disk coils of the least length and have a small number of wings. As these coils have small inductance, after switching-off the amplitude of current in them will be reduced rather quickly.

Besides as switching-off the stator coils is necessary during all the moments of a sinusoid of oscillations, after each half-cycle of oscillation some part of breakers will disconnect coils either on average values, or on values of current about zero. It will decrease the loading on breakers essentially.

By the principle of operation, the offered launcher is directly opposite from the traditional thermodynamic guns and electromagnetic railguns where the gas pressure force or Lorentz's force put pressure upon a bottom of a shell or an armature. In the present invention, the head part of the rotor is pulled in by an active part of the stator, which is located in front of the rotor in direction of its movement and connected to the power supply.

The greatest interest causes a case of vertical acceleration of the rotor. Without taking into account force of aerodynamic resistance, the force equation looks like: $F=F_e-F_t=ma$;

Where F=resulting force;

$F_e$=electromagnetic force;

$F_t$=gravity.

$F_t=mg$;

Where m=rotor's weight;

g=acceleration of free falling;

Thus: $ma=F_e-mg$;

$a=dV/dt=F_e/m-g$;

Where dV/dt=differential of velocity at time or the rotor's acceleration.

The differential equation for the rotor's velocity is shown in FIG. 14

Where V=velocity of the rotor;

$dM_{kb}/dx$=differential of mutual inductance between the stator coil with number "k" and the rotor coil "b" at movement of the rotor at "dx", where "k" changes from "1" to "n".

It is possible to find the movement knowing the velocity. The differential equation for the movement of rotor is shown in FIG. 15.

The system of the differential equations consisting of the system of the differential equations for the stator coils, shown in FIGS. 9, 10, 11 and the equations shown in FIGS. 12, 13, 14, 15 describe electric processes in the electric circuit of the rotor and in the electric circuits of the stator coils, and also the rotor movement as the first approximation.

Having solved the system of the differential equations with the help of numerical method for the real sizes of the rotor and the stator we received results shown in FIGS. 16, 17, 18, 19.

Figure 16:
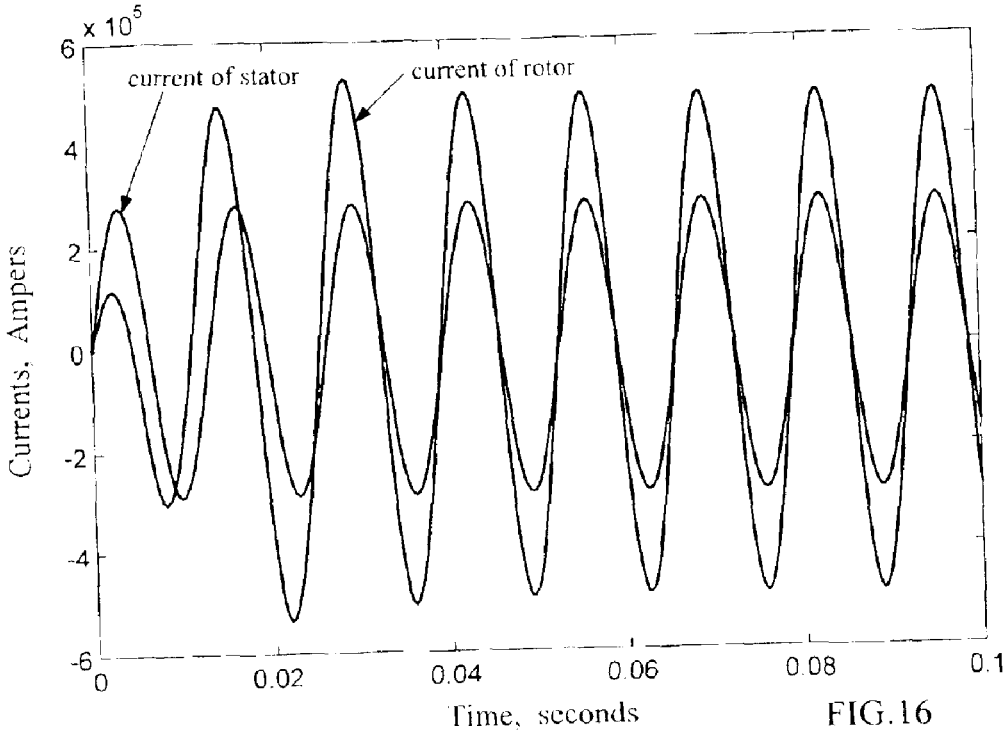
FIG. 16 shows the graphs of current in the stator coils and the rotor coil.

FIG. 16 shows graphs of current in the rotor coil and in the stator coils. The graph of current in the stator coils shows the current for coil with the number "n". The graph for another coil will be identical to the given graph, with a difference, that the current in this coil stops at the moment of switching-off of the breaker.

Figure 17:
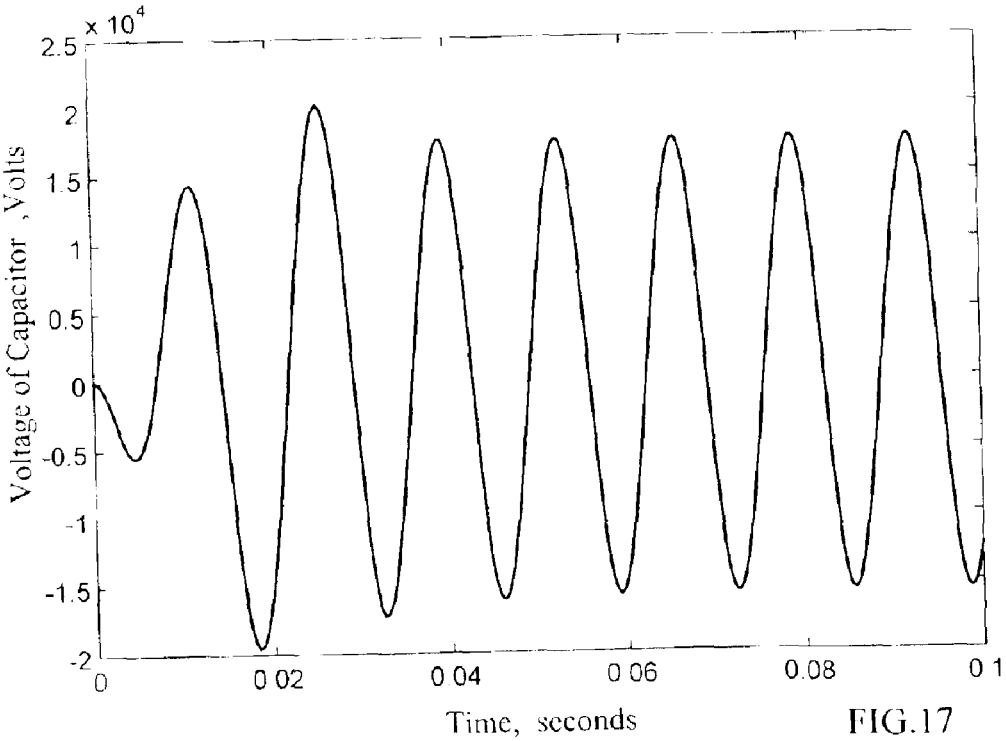
FIG. 17 shows the graph of voltage in the rotor capacitor.

FIG. 17 shows the graph of voltage in the rotor capacitor.

Figure 18:
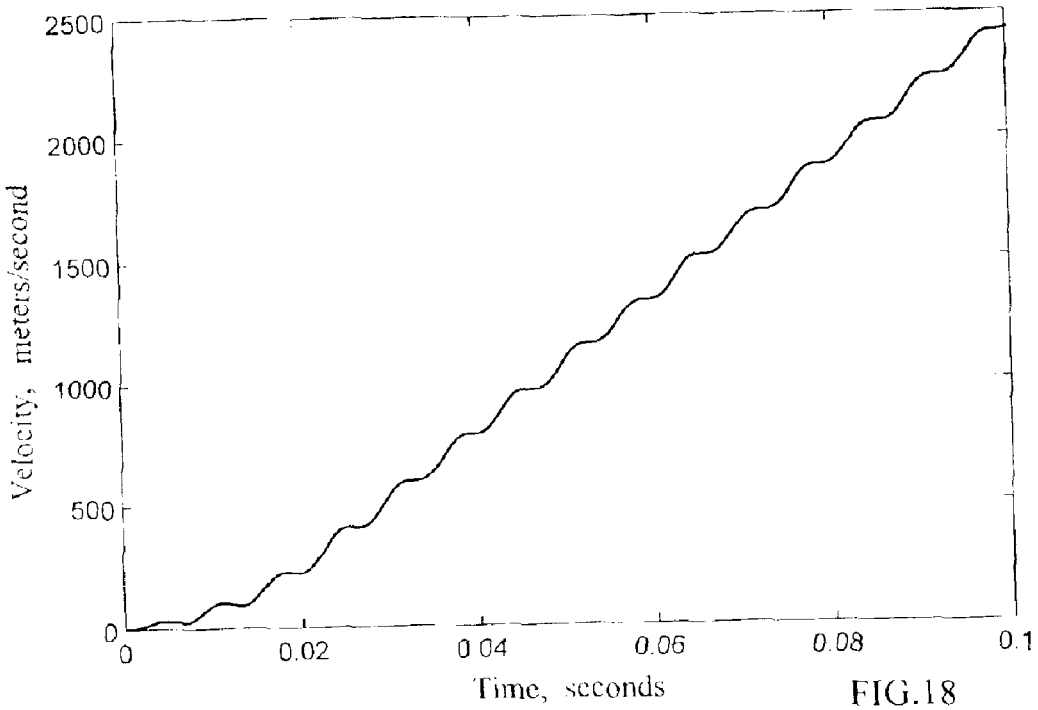
FIG. 18 shows the graph of the rotor velocity.

FIG. 18 shows the graph of the rotor velocity.

Figure 19:
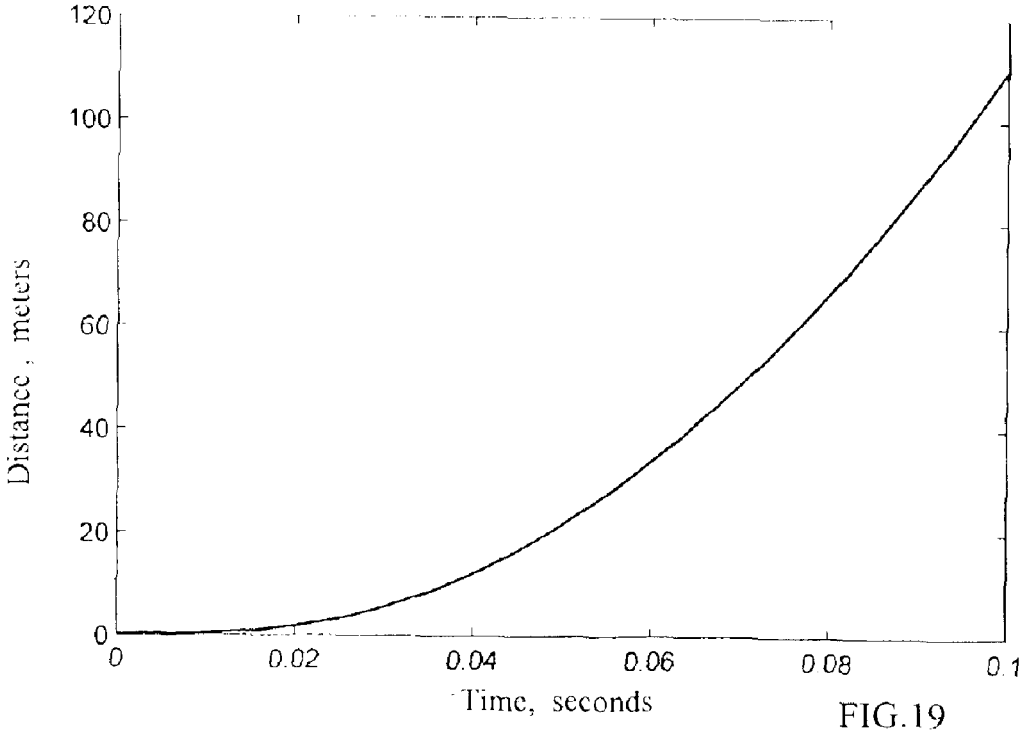
FIG. 19 shows the graph of the rotor movement.
Figure 20:
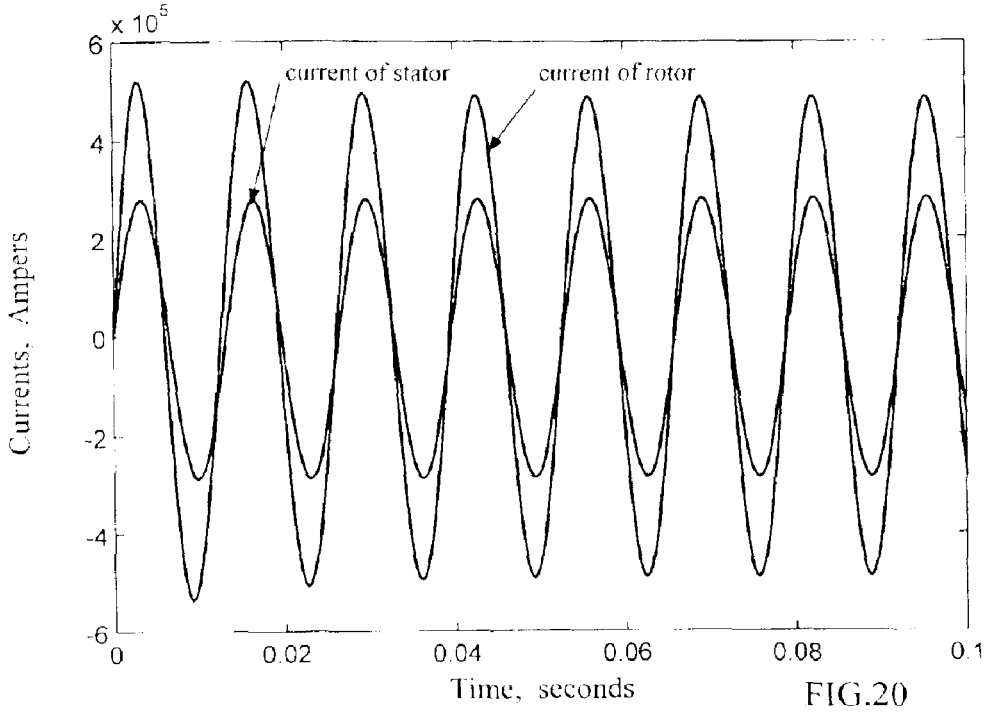
FIG. 20 shows the graphs of the current in the stator coils and the rotor coil at nonzero initial value of voltage in the rotor capacitor.
Figure 21:
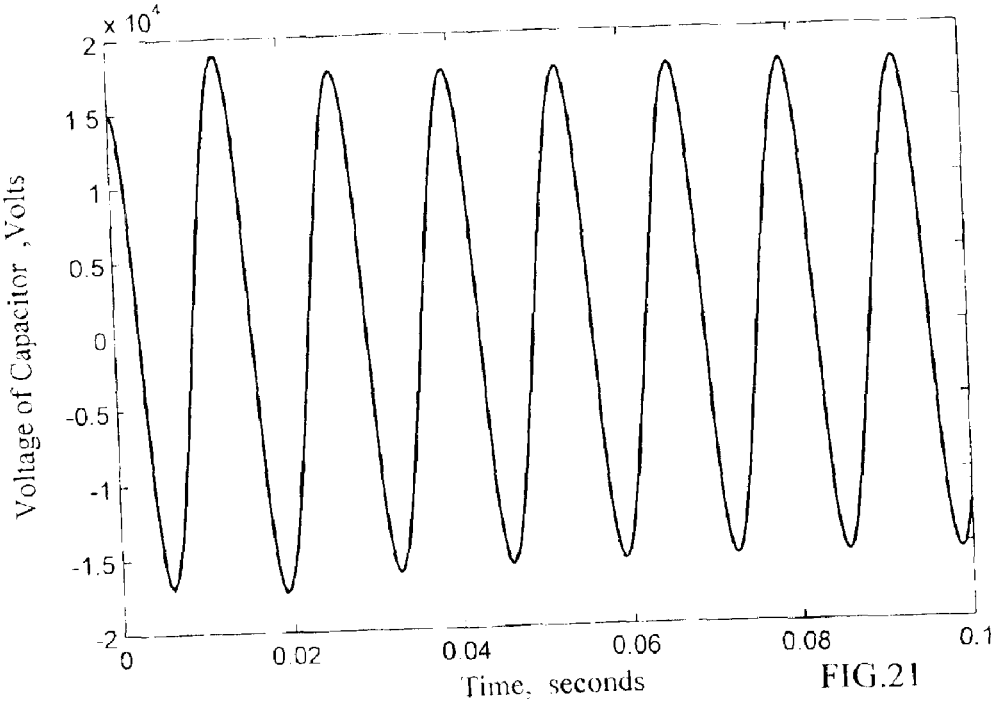
FIG. 21 shows the graph of voltage in the rotor capacitor at nonzero initial value of voltage in the rotor capacitor.
Figure 22:
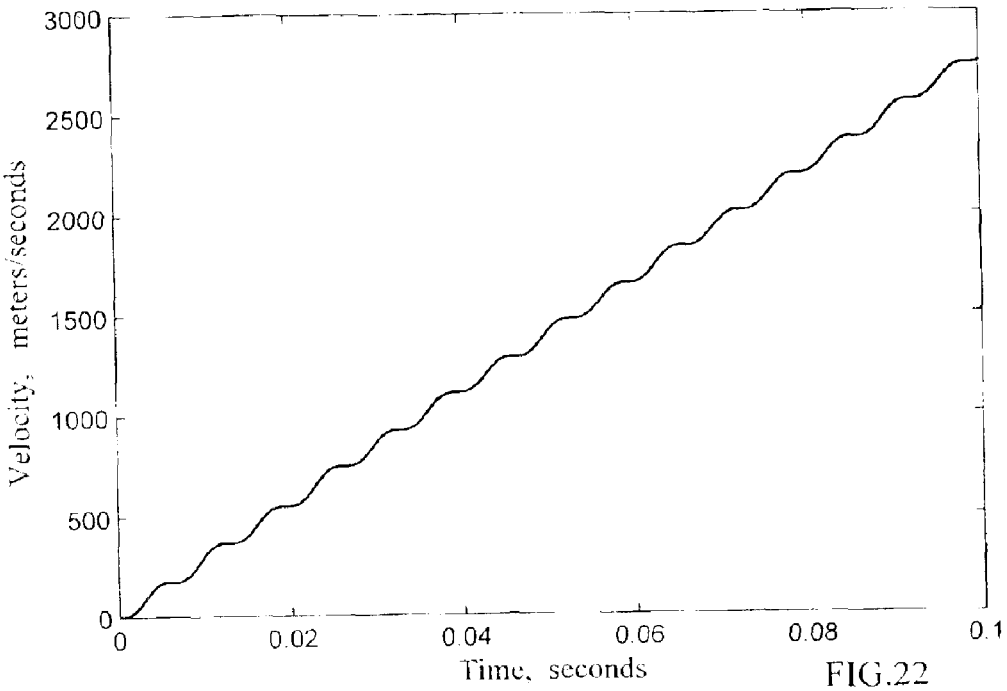
FIG. 22 shows the graph of the rotor velocity at nonzero initial value of voltage in the rotor capacitor.
Figure 23:
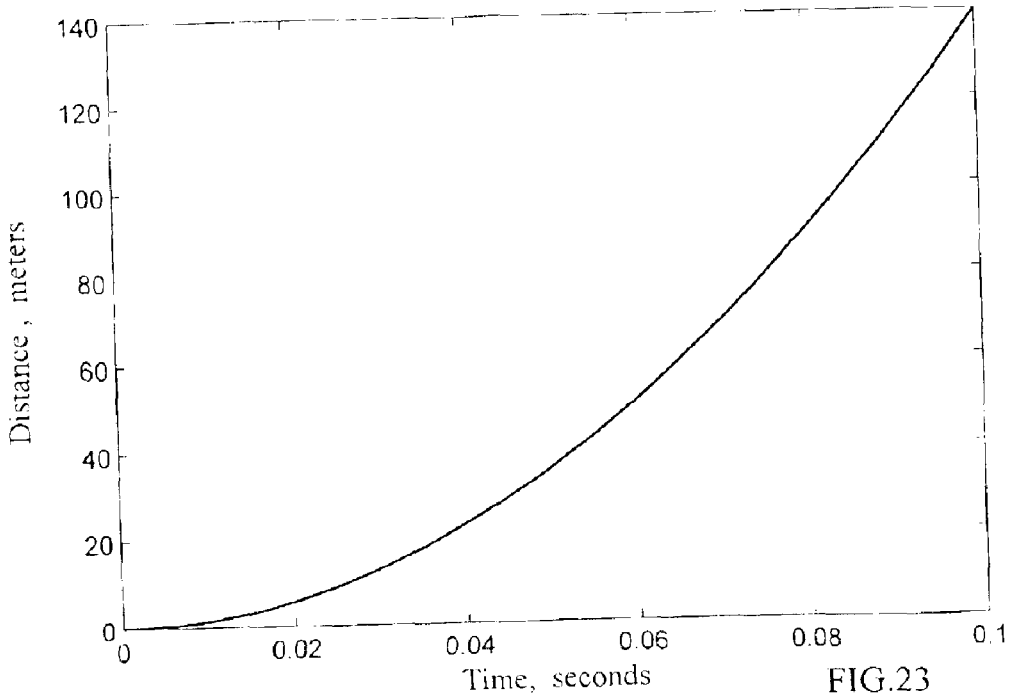
FIG. 23 shows the graph of the rotor movement at nonzero initial value of voltage in the rotor capacitor.

FIG. 19 shows the graph of the rotor movement.

These graphs are shown the variant of the rotor acceleration in case that, a gain of electromagnetic energy of the rotor's electric circuit is equal to a gain of kinetic energy of the rotor and losses in electric resistance of the rotor circuit approximately.

It is obvious, that it is possible to manage process movement of the rotor on the barrel if the elements are connected in electric circuit of any coil so that allows to manage amplitude, frequency or phase of voltage of any coil. There are variants of more intensive acceleration of the rotor or braking of the rotor up to full stop.

In FIG. 18 movement of the rotor with a negative increment of velocity during start of the rotor can be seen.

Currents in the stator coils and in the rotor coil do not coincide with the polarity at those time intervals. It is caused by electromagnetic inertia of the rotor circuit.

A variant of the rotor acceleration with nonzero initial value of electromagnetic energy can be logically considered. For this purpose, nonzero initial value of voltage in the rotor capacitor is established.

The results of the calculation with nonzero initial value of voltage in the rotor capacitor are shown in FIGS. 20, 21, 22, 23.

Thus, if the rotor capacitor to charge to initial voltage before switching-on voltage to the stator coils, or if the resonant electromagnetic oscillations there are already in electric circuit of the rotor, more dynamical start of the rotor can be achieved.

It can be interesting especially for electromagnetic launchers with relatively small length of the barrel.

In the first variant charging the rotor capacitor in breech of the launcher, the rotor's electric circuit is connected to the supply of direct current in series by a special breaker.

Figure 24:
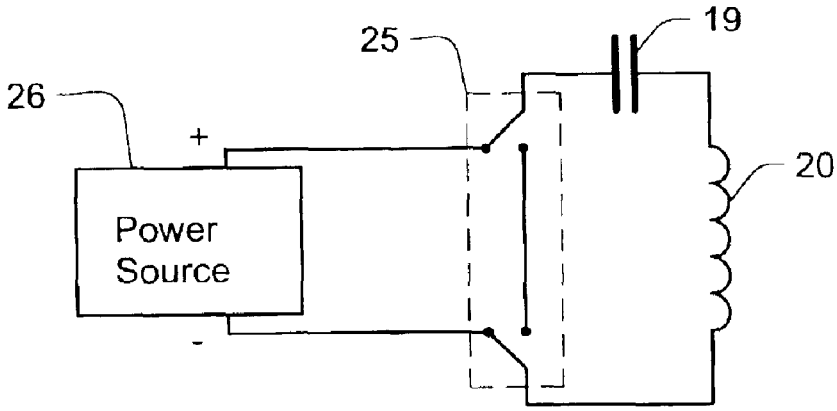
FIG. 24 shows the simplified circuit in which the capacitor and the rotor coil is connected to the source of direct current.

The breaker can be built in one of the rotor wires 11 connecting the capacitor and the coil. The consideration of the breaker design is not the purpose of the present invention. The connection of the rotor circuit in breech of the launcher is shown schematically in FIG. 24.

After the rotor capacitor 19 has been charged up to a required voltage, breaker 25 switches-off the rotor from the power source 26 and it is shorting electric circuit of the rotor, in accordance with the switching-on of voltage on the stator coils.

While the switching-on voltage on the stator it is necessary to coordinate concurrence of the current direction in the rotor coil and in the stator coils. The further process of acceleration is similar to the process of acceleration without starting charging the rotor capacitor.

Figure 25:
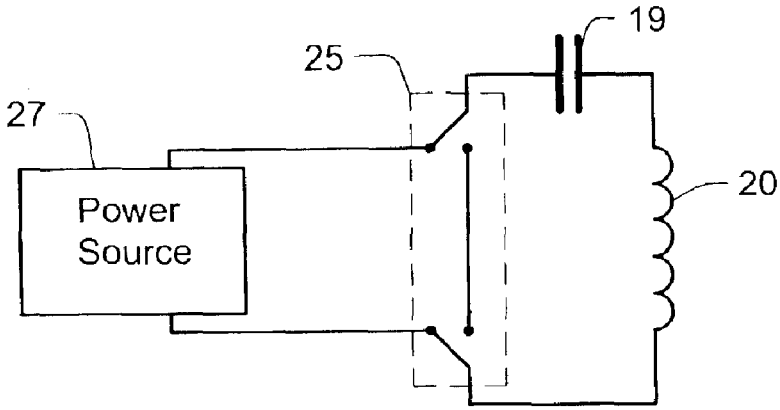
FIG. 25 shows the simplified circuit in which the capacitor and the rotor coil is connected to the alternator in series.

In the second variant, the electric circuit of the rotor is connected in series to the alternator with the frequency that is equal to the own oscillation frequency of the rotor's electric circuit. The circuit is shown in FIG. 25.

The resonance in the rotor's electric circuit increases the amplitude of voltage on the rotor capacitor 19. While the switching the voltage on the stator coils there is a simultaneous switching-off of the rotor's electric circuit from the power source 27 and simultaneously closes the rotor's electric circuit by means of the breaker 25.

While the switching-on voltage at the stator it is necessary to coordinate the concurrence of direction and the phase of current in the rotor coil and in the stator coils.

Probably the best moment of switching will be the moment when the voltage on the rotor capacitor reaches a maximum, and current in the rotor coil is about zero.

Switching-on of the rotor's electric circuit is caused with losses of current in electric arc in the breaker.

It can be avoided, if the rotor's electric circuit is kept constantly closed, and the rotor capacitor and the rotor coil to connect to the alternator in parallel.

Figure 26:
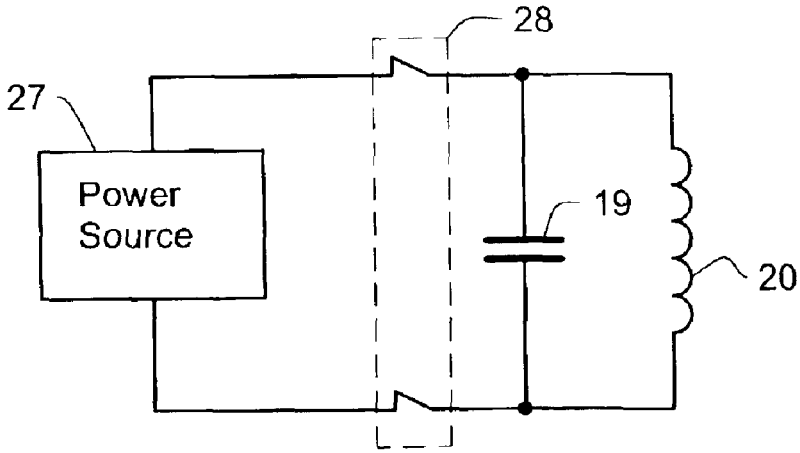
FIG. 26 shows the simplified circuit in which the capacitor and the rotor coil is connected to the alternator in parallel.

The connection of the rotor circuit is shown in FIG. 26.

In the third variant, the rotor coil 20 and the rotor capacitor 19 are connected to the alternating current source 27 in parallel.

The current in conductors and contacts connecting the rotor and the alternating current source 27 is caused only by active resistance of electric circuit of the rotor and it is less than the current flowing in the rotor's electric circuit. Thus, being disconnected the rotor's electric circuit at the starting moment, electric arc processes in the breaker 28 will be not so essential.

The breaker 28 can be connected directly to the rotor wires 11 connecting the capacitor and the coil. Disconnection of the breaker can be at the starting moment of the rotor. Consideration of the breaker design is not the purpose of the present invention.

While the switching-on of voltage on the stator it is necessary to coordinate the concurrence of direction and the phase of current in the rotor coil and in the stator coils.

Figure 27:
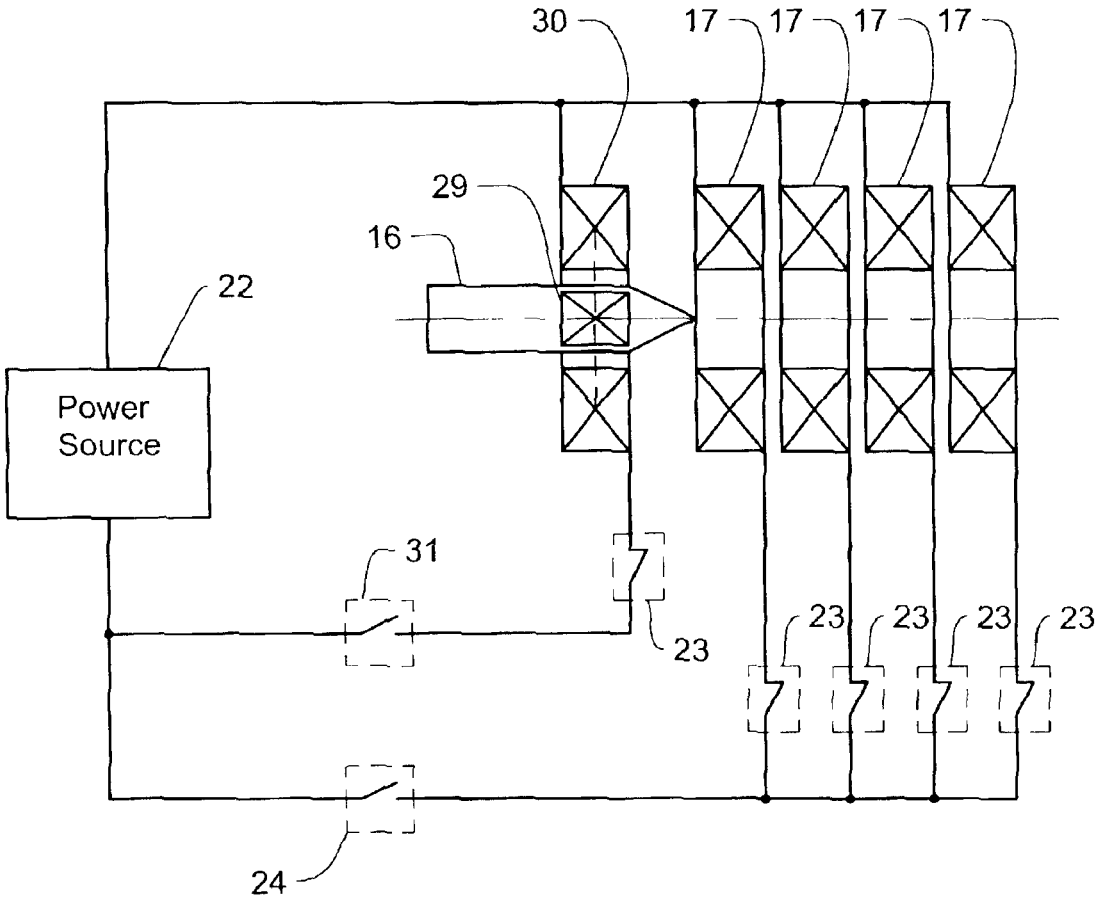
FIG. 27 shows the simplified circuit charging the rotor capacitor by means of mutual inductance from the additional coil in the stator breech.

The fourth variant is shown schematically in FIG. 27.

In the fourth variant, the contact connection of the rotor and the power source avoids completely. The additional coil 30 is placed in breech of the launcher on one axis with the rotor coil 29 so that the centers of the coils coincide. The additional coil 30 is connected to the alternator 22 before the stator coils switching-on. The frequency of the power source is equal to the own oscillation frequency of the rotor's electric circuit. This source can be the power source of the stator.

The breaker 31 is switching-on the coil 30. In connection with the mutual inductance between the coil 30 and the rotor coil 29, the resonant oscillations there are in the rotor electric circuit and electromagnetic energy of the rotor is increasing. The rotor capacitor is being charged to a necessary level of energy. The breaker 24 is connected the stator coils 17 to the power source 22. The breaker 23 in accordance with the movement of the rotor 16 disconnects the coil 30 from the power source 22.

Generally, this coil can be the first coil of the stator. While the switching-on of voltage on the stator it is necessary to coordinate concurrence of direction and phase of currents in the rotor coil and in the stator coils.

Figure 28:
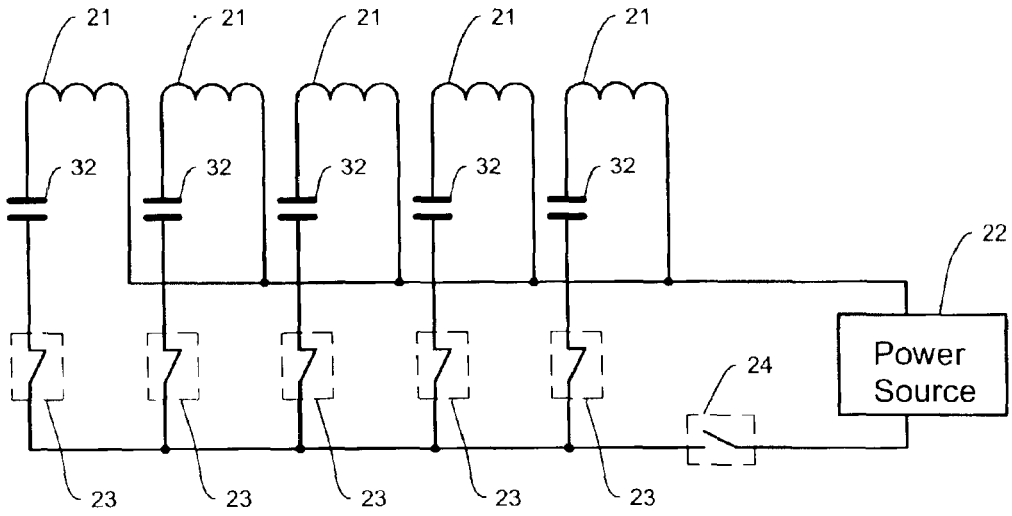
FIG. 28 shows the simplified circuit in which the capacitors are connected to coils of the launcher in series.
Figure 29:
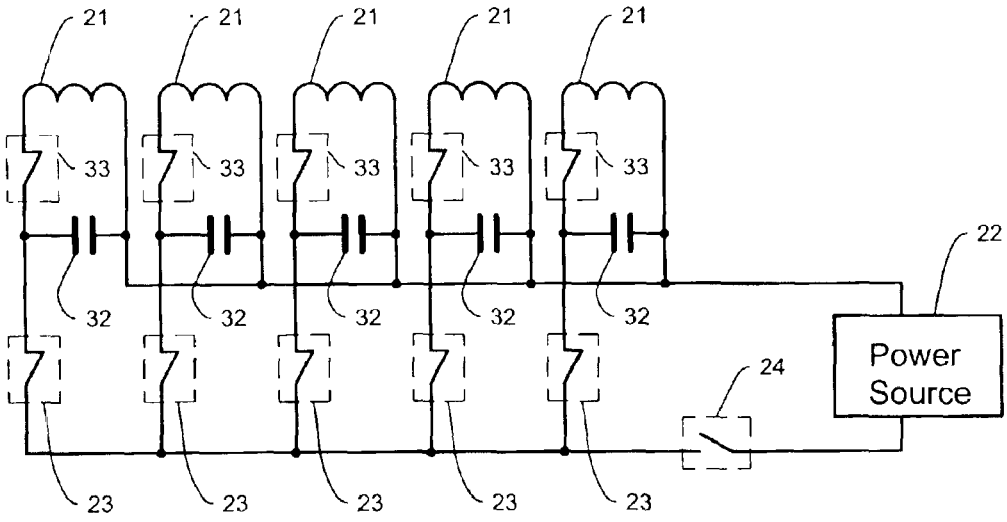
FIG. 29 shows the simplified circuit in which the capacitors are connected to coils of the launcher in parallel.

In some cases, there is a necessity of switching-on the launcher to either low-voltage or low-current sources, for example, in case of accommodation of launcher to the mobile carrier. And also in connection with that the variable sine wave voltage is applied in the present launcher, it is offered the capacitors for connection in circuit of the stator coils. The electric capacity of the capacitors together with inductance of the stator coils forms resonant oscillatory contours. The own oscillation frequency of these contours should be equal to the own oscillation frequency of the rotor's electric circuit and of voltage's frequency. The connection of capacitors to the stator coils is possible both in series and in parallel. The circuit of connection in series is shown in FIG. 28, the circuit of parallel connection is shown in FIG. 29.

For the discontinuance of oscillations in the stator coils with parallel connection it is necessary not only to disconnect them from the power source with the breakers 23, but also to switch off the circuit with the breakers 33.

Electromagnetic resonance in these contours will essentially increase the amplitude of current and amplitude of voltage in the stator coils, and therefore the electromagnetic force of interaction between the rotor and the stator. If the equipment regulating parameters is added to the circuit it is possible to manage resonance and therefore the process of the rotor acceleration.

The process of acceleration is similar to the rotor acceleration described above.

CONCLUSTION

The advantages of using of electromagnetic resonance in the present invention are:

1) using of traditional sources of alternating current;
2) excitation of large current in the rotor coil with the help of relatively small current in the stator coils;
3) increasing of "survivability of a barrel" from relatively small current in the stator coils;
4) possibility of using low-voltage and low-current sources of alternating current;
5) preservation of a part of magnetic energy of the rotor coil as electric energy of the rotor capacitor, with the following transformation in kinetic energy of the rotor movement;
6) switching-off circuit of some the stator coils on the minimal values of current and thus the reduction of the load in breakers of these coils.
7) synchronization of the breakers operation only with the rotor movement on the barrel.

The author understands, that in a reality the processes in the system "rotor-stator" have more complex and nonlinear character in many respects.

It is impossible to speak definitely about the equality of the voltage's frequency to the frequency of own oscillations the rotor circuit. For maintenance of the resonance, the frequency of voltage should differ from the own oscillation frequency of the rotor circuit at a certain value and it should be changing according with the changing of oscillation frequency of the rotor circuit. The purpose of the present invention is to show a basic possibility of acceleration of big weight bodies to the velocity of about 10 km/s and more in the distance of about 1000 meters with using of electromagnetic resonance. If increase of the voltage frequency and the own oscillation frequency of the rotor that the electric capacity of the rotor capacitor and the inductance of the rotor coil are decreased and therefore weight and dimensions of the rotor are decreased too. But jet resistance of electric circuit is increased.

It is both necessary and possible to adjust the amplitude and the frequency of voltage of any coil at the movement of the rotor on the barrel. Thus, it is possible to manage the acceleration and braking of the rotor.

Undoubtedly, it is necessary to apply the powerful generator of alternating current as the power supply of the launcher, but on the other hand, there is not necessity for using of the impulsive high-power stores.

If modes of acceleration sparing for the rotor's electric circuit are used, there will be possibility of using of the rotor in quality of multiple accelerating element.

And also, if a mobile rod is attached to the rotor it is possible to use the launcher for starting acceleration of airplanes on aircraft carriers instead of a steam catapult.

I claim:

1. An electromagnetic launcher comprising:

(A) a rotor, including:

(i) a cylindrical case made from a non-metal material having a head part and a bottom part, (ii) a coil located coaxial in said head part of said case, (iii) a capacitor located in said bottom part of said case is electrically connected to said coil in an electric circuit;

(B) a stator consisting of an array of identical coaxial coils, wherein said array has a breech end and a muzzle end, an internal diameter of said coils is larger than an external diameter of said rotor at a small gap;

(C) an alternator electrically connected to each coil of said coils of said stator in parallel, wherein a frequency of said alternator is equal to a frequency of resonant electromagnetic oscillations in said electric circuit of said rotor.

2. The electromagnetic launcher as in claim 1, wherein means for disconnecting said coils of the stator from the alternator in accordance with a movement of the rotor and consequently in a direction from said breech end to said muzzle end of the stator.

3. The electromagnetic launcher as in claim 1, wherein a means for charging said capacitor of the rotor to nonzero amplitude of a voltage before switching the alternator to the stator.

4. The electromagnetic launcher as in claim 1, wherein capacitors are connected in electric circuits of said coils of the stator for exciting an electromagnetic resonance in said circuits of said coils of the stator.

* * * * *